US005806228A

United States Patent [19]

Martel et al.

[11] Patent Number: 5,806,228

[45] Date of Patent: Sep. 15, 1998

[54] SCOPE MOUNT FOR THE CARRYING HANDLE OF M-16 TYPE RIFLES

[76] Inventors: Phillip C. Martel, 48101 Deer Trail Dr., Canton, Mich. 48187; Carl M. Martel, 221 N. Golden Beach Dr., Kewadin, Mich. 49648-9742

[21] Appl. No.: 748,204

[22] Filed: Nov. 12, 1996

[51] Int. Cl.[6] ..... F41G 1/38

[52] U.S. Cl. ..... 42/101; 42/103; 42/100

[58] Field of Search ..... 42/101, 103, 100; 33/233; 89/1.61

[56] References Cited

U.S. PATENT DOCUMENTS

| | | | |
|---|---|---|---|
| 3,742,636 | 7/1973 | Dealy et al. | 42/13 |
| 3,777,380 | 12/1973 | Theodore | 42/18 |
| 3,939,589 | 2/1976 | Tellie | 42/71 R |
| 3,986,285 | 10/1976 | Krisay | 42/18 T |
| 4,455,776 | 6/1984 | Ashley et al. | 42/18 T |
| 4,845,871 | 7/1989 | Swan | 42/101 |
| 5,142,806 | 9/1992 | Swan | 42/101 |
| 5,390,419 | 2/1995 | Sirkis | 33/250 |
| 5,522,166 | 6/1996 | Martel | 42/101 |
| 5,533,292 | 7/1996 | Swan | 42/100 |
| 5,555,662 | 9/1996 | Teetzel | 42/103 |
| 5,590,484 | 1/1997 | Mooney et al. | 42/100 |

OTHER PUBLICATIONS

SWAT/Quality Parts Co., Match Rifle and Scope Mounts, Jan. 1996, 2 pp.

*Primary Examiner*—Charles T. Jordan
*Assistant Examiner*—Meena Chelliah
*Attorney, Agent, or Firm*—Young & Basile, P.C.

[57] ABSTRACT

An improved scope mounting base for securing a scope to the carrying handle of M-16 type rifles without interfering with the sight tunnel formed through the top of the carrying handle. In a preferred form the scope mounting base comprises a readily detachable, elongated body having a generally U-shaped interior handle-engaging contour which mates securely to the undersigned exterior surfaces of the carrying handle, and exterior scope-mounting surfaces located along the exterior side surfaces of the carrying handle. This arrangement leaves the sight tunnel through the top of the carrying handle unobstructed, and allows the detachable base to remain on the rifle when the scope is removed while still permitting the unimpaired use of the iron sights. In an alternate embodiment the exterior scope-mounting surfaces, preferably in the form of dovetail-type rails such as Weaver or NATO Stanag, are formed integrally into the exterior side surfaces of the carrying handle.

16 Claims, 4 Drawing Sheets

FIG-3
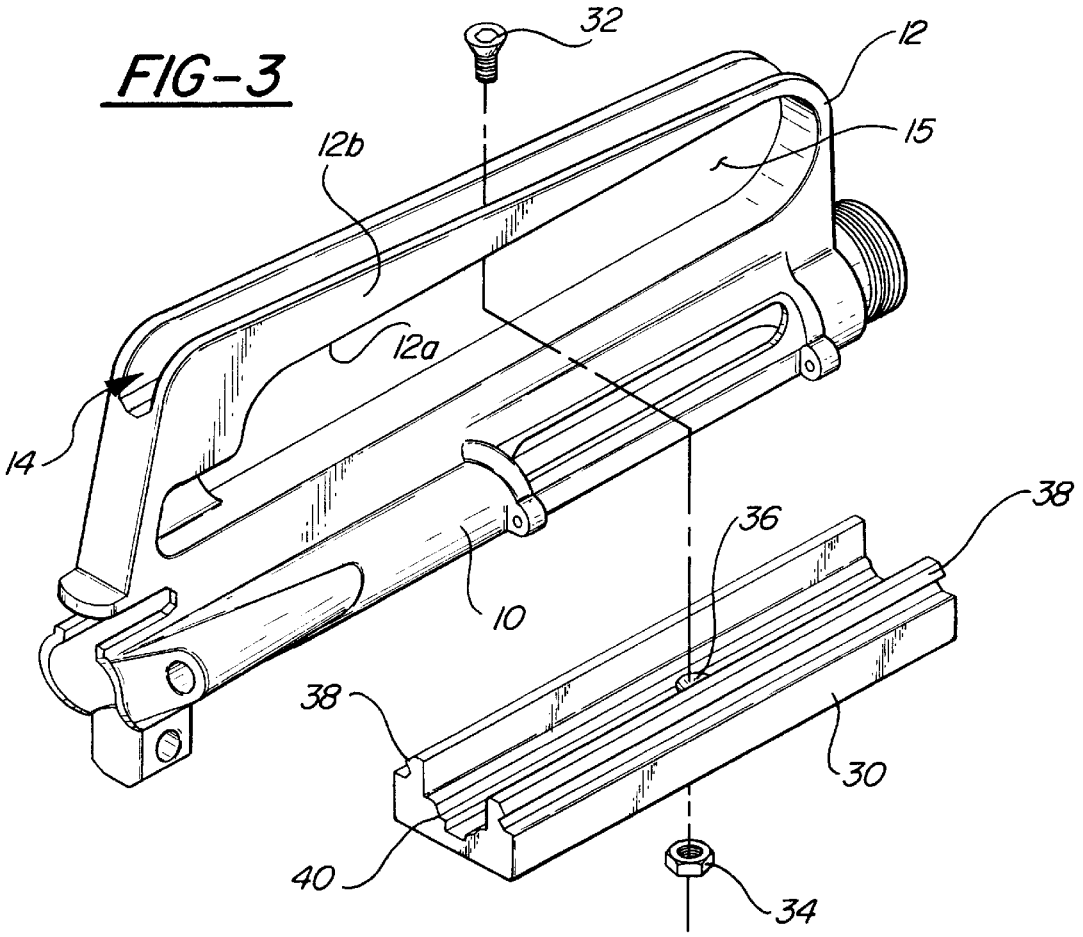
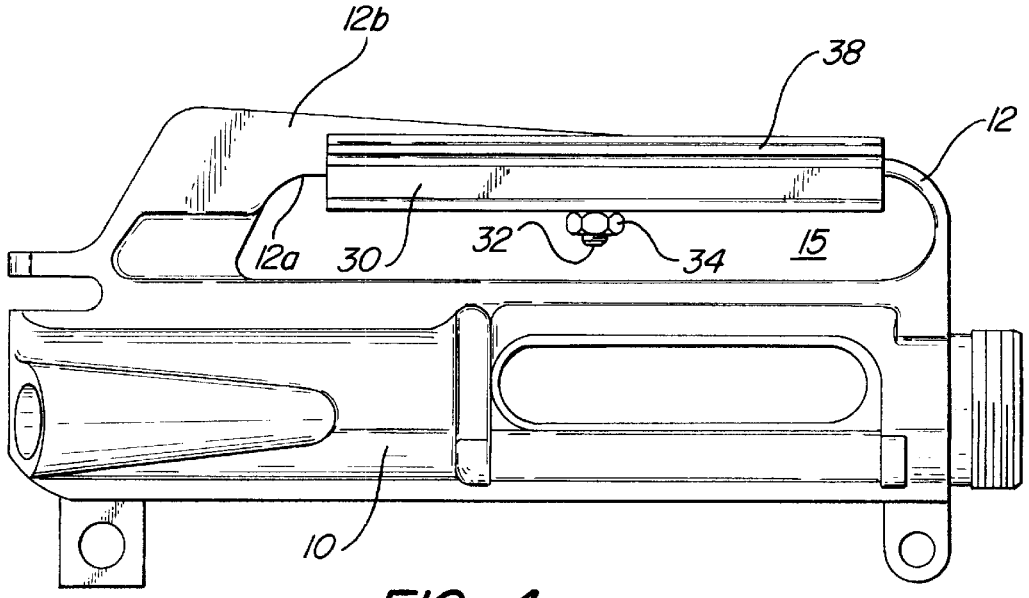
FIG-4

SCOPE MOUNT FOR THE CARRYING HANDLE OF M-16 TYPE RIFLES

FIELD OF THE INVENTION

The present invention generally relates to firearm-mounted bases for telescopic sights, and more particularly to scope mounting bases for the carrying handle portion of the upper receiver of M-16 type rifles.

BACKGROUND OF THE INVENTION

The term "scope" will be used herein to mean firearm sighting systems including, but not limited to, telescopic sights, optical sights, night vision sights, and laser and infrared sighting/illuminating devices currently known for use on firearms.

The military M-16 type rifle and numerous commercial/civilian counterparts such as the Colt® AR-15, are typically equipped with a distinctive and well-recognized carrying handle on the upper receiver. Throughout this application terms such as "M-16", "M-16 type" or "M-16 family" will be used to refer to all rifles incorporating the M-16 style carrying handle. In addition to functioning as a carry handle, the handle functions as the primary sight platform for the rifle; i.e., the rear mechanical or "iron" sights are mounted toward the back of the handle, and a hollowed out sight tunnel running the length of the handle permits see-through alignment of the rear sight with a front sight mounted on the forward part of the barrel.

The carrying handle is typically formed as an integral part of the M-16 rifle's upper receiver, and is accordingly an integral part of the rifle which must be taken into account when mounting a scope to the rifle.

Most military scopes and scope ring mounts and many commercial scopes and ring mounts are designed to mate with a scope mounting base of the dovetail-type rail system. Two common dovetail-type rail systems are the Weaver® system and the similar NATO Stanag system.

There have been two general approaches to putting a dovetail-type rail base on M-16 type rifles: mounting the scope base in the carrying handle's sight tunnel, or removing the handle completely to form or add the scope base to the upper receiver (known in the art as a "flattop" configuration).

The more common and less costly scope mounting systems are those adapted to the carrying handle. Scope mounting bases for M-16 type rifles with carrying handles are mounted to the handle in "drop-in" fashion, where the scope base is laid in the sight tunnel of the handle and fastened by a screw or thumb nut inserted through the handle from the underside. A representative example of a typical prior art drop-in system is shown in FIG. 1. An M-16 type upper receiver 10 includes an integral carrying handle 12 having a sight tunnel 14 for using the "iron sights" 17 (FIG. 2) typically supplied with the basic rifle. Prior art scope base 16 is mounted to carrying handle 12 by inserting it in sight tunnel 14 and locking it in place with a thumb nut 18 inserted into a mating tapped hole (not shown) in scope base 16 from the underside of handle 12 through an aperture formed in the handle.

Referring to both FIGS. 1 and 2, the prior art drop-in mount 16 includes its own see-through tunnel 22 running between longitudinal dovetail-type mounting rails 20.

There are several problems with the prior art drop-in mounts. First, the sight tunnel 14 in the carrying handle is the rifle's primary sighting mechanism. The military is believed to require, and many sportsman prefer, that scope mounting systems preserve this primary iron sighting function by maintaining a see-through sight tunnel underneath the mounted scope. This is illustrated in FIG. 2, in which the see-through tunnel 22 in drop-in base 16 still permits use of the rifle's iron sights 17. The problem with prior art drop-in bases, however, is that they either completely obstruct the sight tunnel, or reduce it to an undesirably narrow field of view. For example, the drop-in base 16 shown in FIGS. 1 and 2 reduces the field of view by at least 50%, an especially significant problem for close-up shots where the scope is of no use.

Another problem with prior art drop-in handle bases is that they do not provide a truly solid, repeatable-zero mounting arrangement.

These and other problems are solved by the scope mounting base of the present invention.

SUMMARY OF THE INVENTION

In general the present invention is an underrail scope mounting base which mounts to the underside of the carrying handle to eliminate the problems associated with drop-in bases secured in the carry handle sight tunnel. The underrail scope base leaves an unobstructed sight tunnel through the carrying handle underneath the scope.

An additional feature of the inventive underrail scope base is a self-centering interior contour designed specifically for the underside of the M-16 type carry handle, which has radiused edges and a rough ridge of milled aluminum running the length of the underside of the handle.

A further feature of the inventive underrail scope base is a double-V exterior rail profile with an underside support flat to support the bottom side surfaces of scope ring mounts.

Unlike drop-in scope bases which frequently claim "repeatable zero" because they need to be removed and reattached depending on whether a scope is being used or not, the inventive underrail scope base is completely out of the way of the sight tunnel, whether a scope is mounted or not, and never needs to be removed, even though it is easily installed as an aftermarket accessory.

In an alternate embodiment, the unique exterior rail profile of the invention is forged or milled into the carry handle itself during the manufacturing process, thereby forming a permanent underrail base similar to the add-on embodiment described above.

BRIEF DESCRIPTION OF THE DRAWINGS

FIG. 3 is a rear perspective view of an M-16 type carrying handle and an underrail scope base according to the present invention;

FIG. 4 is a side view of the underrail scope base of FIG. 3 assembled to the M-16 carrying handle;

DETAILED DESCRIPTION OF THE ILLUSTRATED EMBODIMENT

Figure 2:
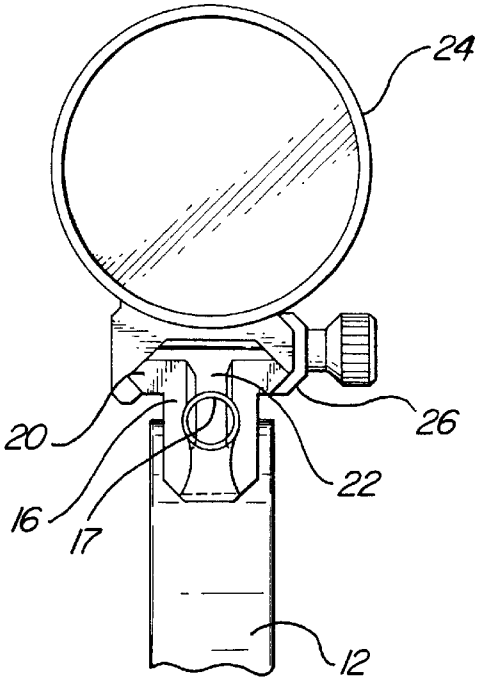
FIG-2 PRIOR ART
FIG. 2 is a rear end view of the prior art receiver/handle/drop-in base system of FIG. 1, with a scope attached to the base.
Figure 1:
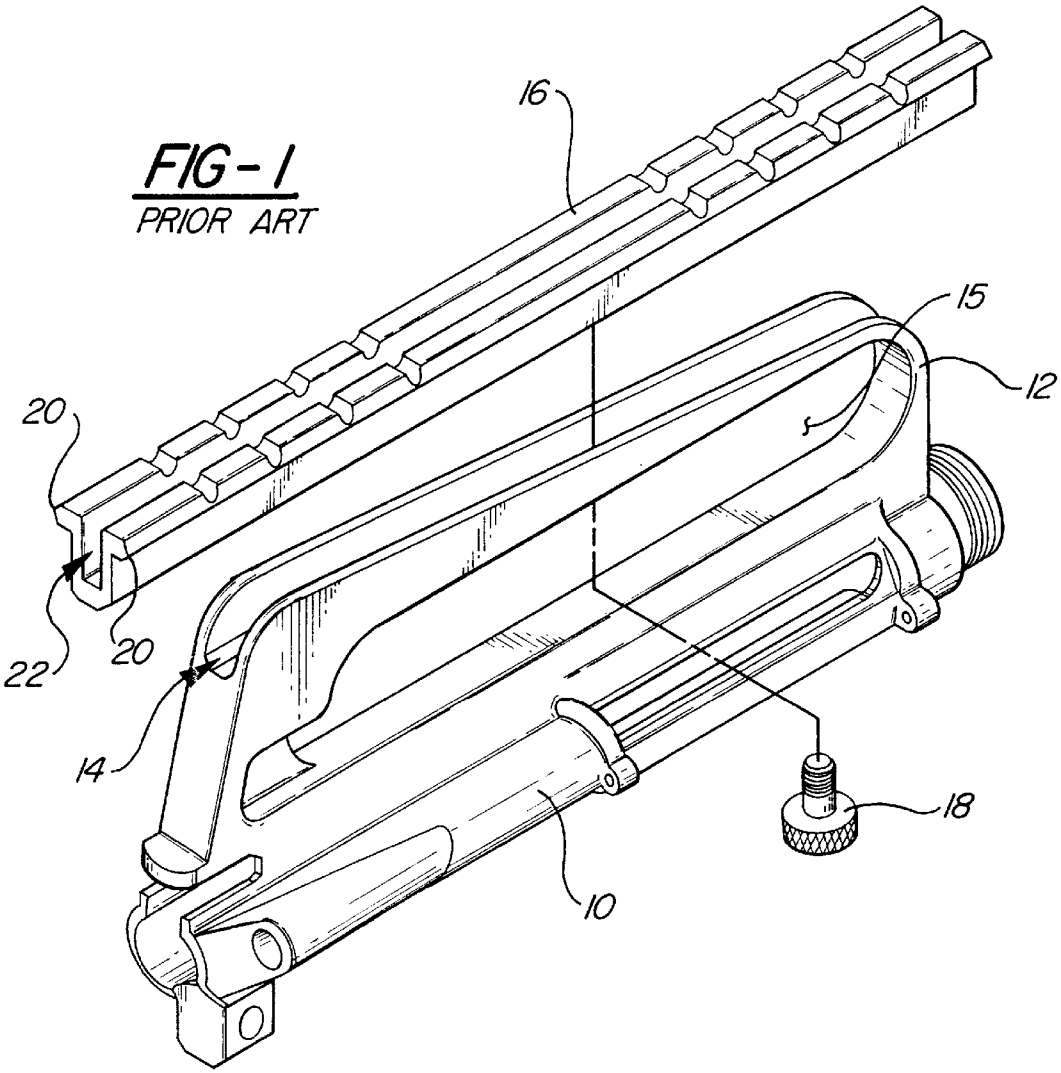
FIG-1 PRIOR ART
FIG. 1 is a rear perspective view of an M-16 type upper receiver with integral carrying handle, illustrating the relationship of a prior art drop-in scope base to the handle.

Referring to FIGS. 3 and 4, an underrail scope mounting base according to the present invention is illustrated at reference numeral 30. Underrail base 30 comprises an elongated body having exterior mounting rail surfaces 38 and an interior handle-receiving recess having a profile or contour 40 adapted to securely mate with the underside surfaces of the carrying handle 12 on the rifle. Base 30 is preferably machined from a solid block of strong, light-weight metal such as hardened aluminum (similar to the material in upper receiver 10), but can be made from other materials such as high strength polymers or steel, for example.

Base 30 is fitted to the underside of carrying handle 12 and locked in place with a simple bolt/nut arrangement 32, 34 extending through suitable apertures in the carrying handle 12 (not shown) and in base 30 (aperture 36). As will be described in further detail below, the aperture in carrying handle 12 is preferably beveled and/or slightly recessed so that a flat-headed bolt as shown at 32 will fit essentially flush with the bottom surface of sight tunnel 14.

As best shown in FIG. 4, once base 30 has been installed on the underside of carrying handle 12, it is essentially out of the way, leaving sight tunnel 14 totally unobstructed and with only minimal obstruction of the opening 15 in the carrying handle. Base 30 can accordingly be left on the rifle when the scope is removed without impairing the function of the iron sights.

Figure 5:
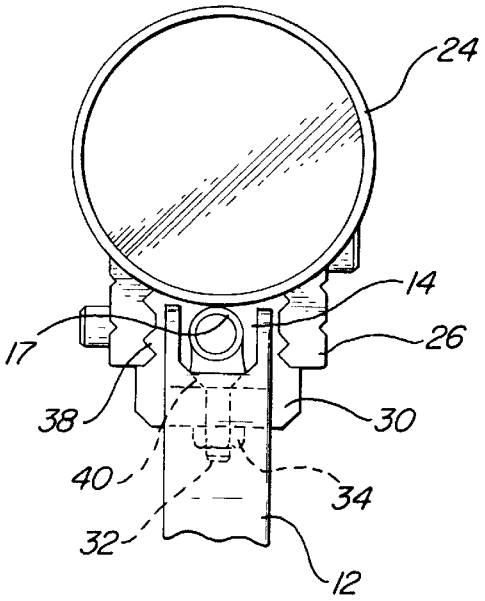
FIG. 5 is a rear end view of the inventive underrail base of FIG. 4, assembled to the carrying handle and with a scope attached.

Referring to FIG. 5, a telescopic sight 24 is shown mounted to carrying handle 12 on the rifle using base 30 and a ring mount system according to my co-pending U.S. patent application Ser. No. 08/625,964 filed Apr. 1, 1996, the specification of which is incorporated herein by reference with respect to the description of the ring mounting system illustrated. It will be understood by those skilled in the art, however, that virtually any known ring mount arrangement for dovetail-type rail mounting systems can be used. For example, most ring mounts that fit Weaver and NATO Stanag type bases will fit on base 30 of the present invention.

FIG. 5 illustrates the unobstructed sight tunnel 14 which is available when using base 30 according to the present invention. The amount of viewing area available above sight tunnel 14 will depend to some extent on the type of ring mount 26 employed, as well as the diameter of the eyepiece bell 24*a* of scope 24. However, reductions in the sight tunnel's field of view for the iron sights will not be attributable to the scope mounting base itself as with prior art systems.

Figure 7:
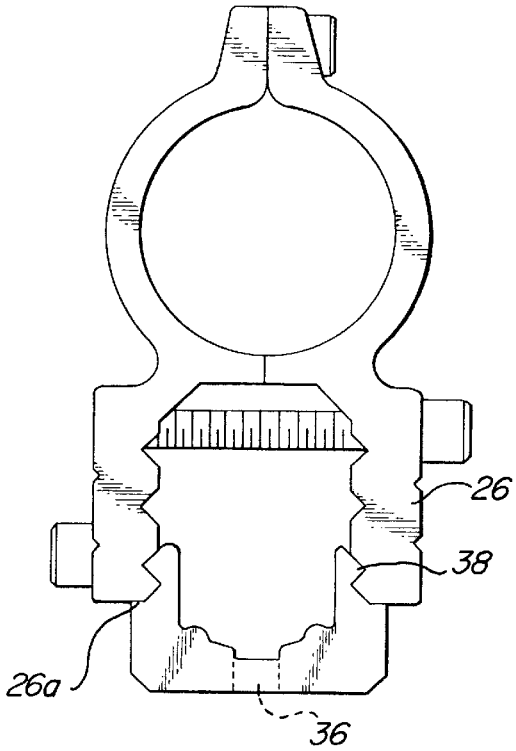
FIG. 7 is a rear end view of the underrail scope base of FIG. 6, not assembled to a rifle, but with a scope ring attached.
Figure 6:
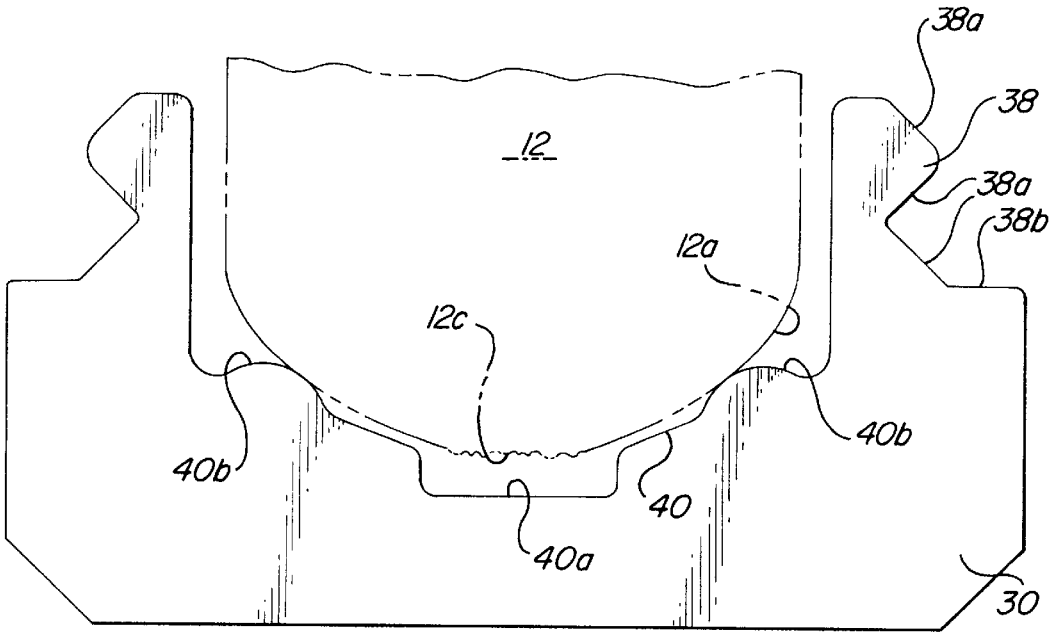
FIG. 6 is a detailed end view of the cross-section of the inventive underrail scope base of FIG. 3.

FIG. 6 is an end view of base 30 described in the foregoing drawings, and in particular shows the interior contour or profile 40 of handle-engaging recess in the base and the shape of the external mounting rails. Longitudinal mounting rails 38 have an exterior profile comprising a "double V" rail surface 38*a* with three alternating angled surfaces, and a lower support flat 38*b* located laterally outward of the rail surfaces 38*a* to provide an anti-rocking base for the ring mounts, as best shown in FIGS. 5 and 7. The lateral clamping force of the ring mounts 26 fastens the rings to rail surfaces 38*a,* while the lower surfaces 26*a* of rings 26 are securely supported on flats 38*b* to further prevent rocking or rotation and to reduce the likelihood of misalignment of the rings on rail surfaces 38*a*.

Looking now to the recessed, handle-mating interior profile of base 30, it comprises a generally U-shaped contour designed to securely engage the generally U-shaped, slightly rounded underside of carrying handle 12. Interior contour 40 includes a recessed central channel 40*a* running the length of the mount to provide clearance for the rounded centerline on the bottom of carrying handle 12 and the line of slag or rough mill marks typically left on the bottom centerline of the carrying handle after the receiver has been machined. This prevents irregularities from affecting the fit and alignment of base 30 to the handle. Interior contour 40 also includes a pair of parallel, self-centering, rounded contact points 40*b* preferably running the length of the mount. Rounded contact points or rails 40*b* are raised from the general interior contour 40 and are radiused to engage the rounded edges of the undersurface of carrying handle 12, which are common to M-16 type rifles. Rails 40*b* provide a self-centering function for the scope mounting base which, along with central clearance channel 40*a,* ensures a precise, properly aligned fit with carrying handle 12 to produce what is known as a "repeatable zero" if base 30 is removed and reattached.

FIG. 7 illustrates the ring mounts from my previously-mentioned co-pending patent application, illustrated without a scope for clarity, engaging a base 30 according to my present invention, illustrated apart from the carrying handle 12, also for purposes of clarity.

Figure 8:
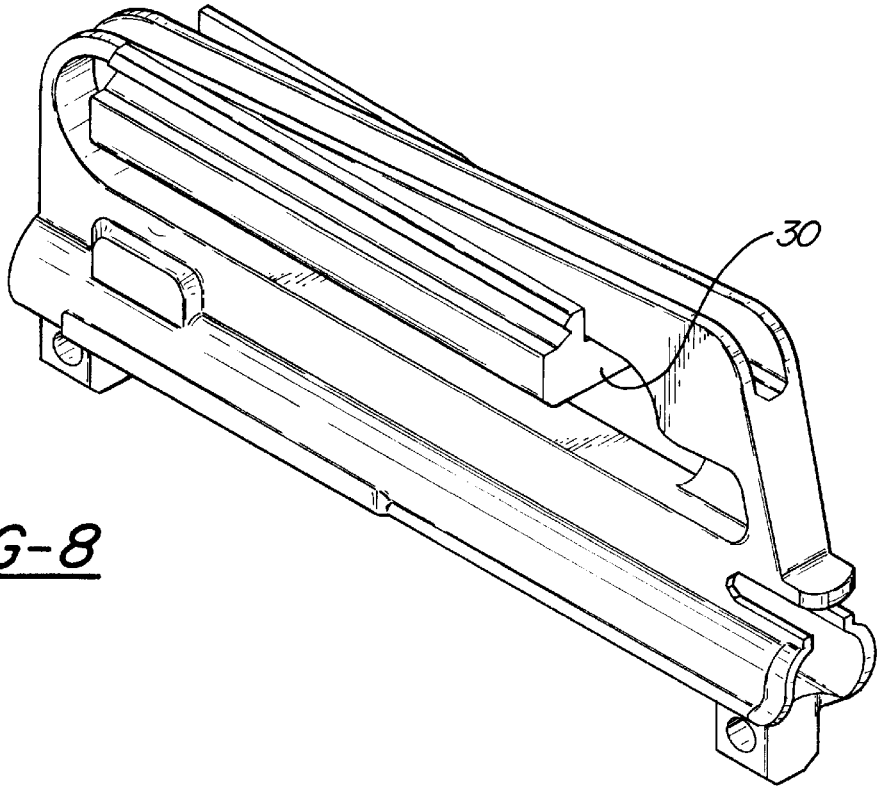
FIG. 8 is a rear left side perspective view of the carrying handle with the inventive underrail scope base attached.

FIG. 8 illustrates the scope mounting base of the present invention from the left rear side of the receiver.

Figure 9:
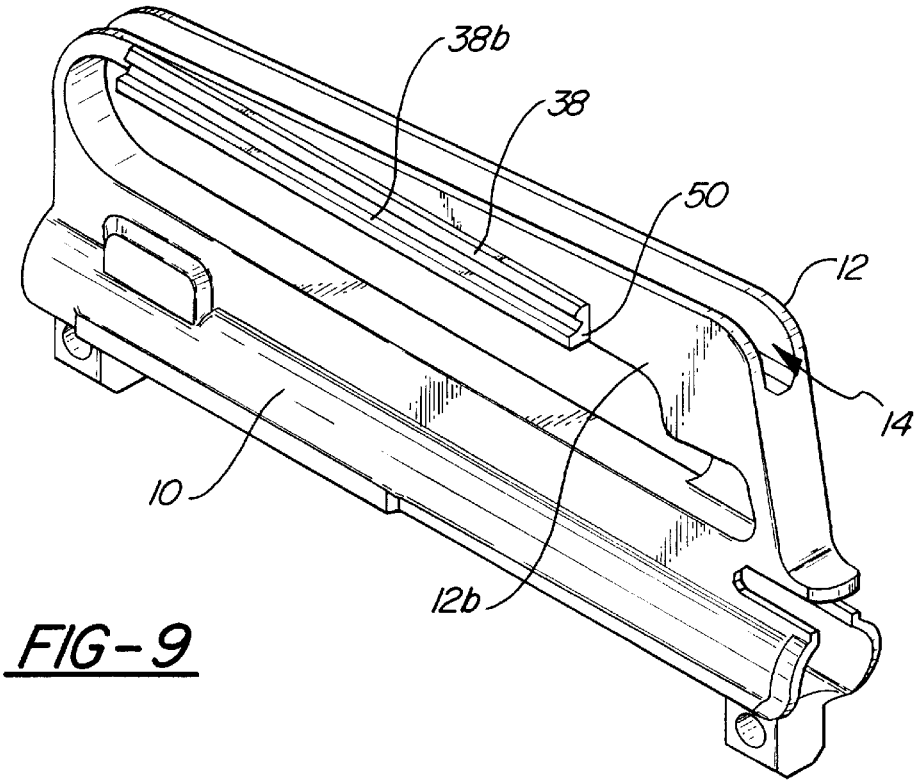
FIG. 9 is a rear left side perspective view of an alternate embodiment of the invention in which the mounting rails are formed as an integral part of the carrying handle.

FIG. 9 illustrates an alternate embodiment of the invention in which the exterior rails 38 are formed integrally with the carrying handle 12 during the manufacture of upper receiver assembly 10. In this alternate embodiment the unique rail surfaces 38 are formed directly into the carrying handle as a permanent feature of the handle. Currently, the add-on (and detachable) scope mounting base 30 illustrated in FIGS. 3–8 is preferred, but FIG. 9 shows that the unique exterior rail surface shown in the illustrated embodiment is adaptable to different mount arrangements.

It should be understood that I do not intend to limit my invention to the preferred embodiment illustrated above, but believe my invention to lie in the broad concept and structure of an underrail scope mounting base for the carrying handle of M-16 type rifles. While the interior handle-mating profile and exterior rail contours illustrated in FIGS. 3–8 are presently preferred embodiments, variations of one or both are possible without departing from the scope of my underrail mounting invention.

We claim:

1. An improved scope mounting base for a carrying handle on an M-16 type rifle, the carrying handle having a sight tunnel, comprising:

a scope mounting base adapted to be assembled to the underside of the carrying handle to provide a scope mounting surface on an exterior side surface of the carrying handle in a manner which leaves the sight tunnel through the carrying handle unobstructed by the base, wherein the exterior scope mounting surface comprises a dovetail-type rail surface.

2. The scope mounting base of claim 1, wherein the dovetail-type rail surface comprises a double V mounting surface comprising three alternately angled surfaces.

3. The scope mounting base of claim 2, wherein the dovetail-type rail surface further includes a flat support surface located laterally outward of the double V rail surface to provide an anti-rocking base for a lower surface of a ring mount.

4. The scope mounting base of claim 1, wherein the base comprises a one-piece longitudinal base having an open faced, generally U-shaped handle-engaging interior contour designed to be clamped against the underside of the carrying handle, the base terminating at its open face in spaced scope mounting rails positioned to be located along exterior side surfaces of the carrying handle when the base is clamped against the underside of the carrying handle.

5. An improved scope mounting base for a carrying handle on an M-16 type rifle, the carrying handle having a sight tunnel, comprising:

a scope mounting base adapted to be assembled to the underside of the carrying handle to provide a scope mounting surface on an exterior portion of the carrying handle in a manner which leaves the sight tunnel through the carrying handle unobstructed by the base, wherein the base comprises an elongated body having a recessed, generally U-shaped handle-engaging interior contour for mating with the underside of the carrying handle, and an exterior dovetail-type rail mounting surface positioned on a side of the carrying handle when the base is attached to the handle.

6. The scope mounting base of claim 5, wherein the base is attached to the carrying handle with a threaded fastener extending through mating apertures in the carrying handle and the base.

7. The scope mounting base of claim 5, wherein the handle-engaging interior contour of the base includes a recessed central channel aligned with and spaced from the centerline of the underside of the carrying handle when the base is attached to the handle.

8. The scope mounting base of claim 7, wherein the handle-engaging interior contour further includes a rounded, longitudinal handle-contacting rail on each side of the recessed central channel, the handle-contacting rails engaging a radiused underside edge of the carrying handle when the base is attached to the handle to center the base on the handle.

9. The scope mounting base of claim 8, wherein the handle-contacting rails are raised relative to the remainder of the handle-engaging interior contour such that contact between the underside of the carrying handle and the base is limited to the rails.

10. An improved scope mounting base for attaching a scope to a carrying handle on an M-16 type rifle, the carrying handle having a sight tunnel, comprising:

an underrail scope mounting base comprising a one piece longitudinal base having an open faced, generally U-shaped handle-engaging interior contour designed to be clamped against the underside of the carrying handle, the base terminating at its open face in spaced scope mounting rails positioned to be located along exterior side surfaces of the carrying handle when the base is clamped against the underside of the carrying handle, wherein the generally U-shaped handle-engaging interior contour comprises a central recessed channel spaced from the centerline of the undersurface of the carrying handle, and a rounded centering rail located on each side of the central channel, the rounded centering rails being raised relative to the interior profile to engage radiused side edges of the underside of the carrying handle.

11. The scope mounting base of claim 10, wherein the base is machined from a single piece of strong, lightweight metal.

12. An improved scope mounting base for securing a scope to a carrying handle on an M-16 type rifle, the carrying handle having a sight-tunnel, comprising:

scope mounting rails located along the exterior side surfaces of the carrying handle, wherein the scope mounting rails are formed integrally with the exterior side surfaces of the carrying handle.

13. The scope mounting base of claim 12, wherein the rail mounting surfaces are part of a detachable scope mounting base having a generally U-shaped interior handle-engaging contour which mates to the underside exterior surfaces of the carrying handle.

14. The scope mounting base of claim 12, wherein the scope mounting rails comprise dovetail-type rail surfaces.

15. An improved scope mounting base for a carrying handle of an M-16 type rifle, the carrying handle having a sight tunnel, comprising:

a scope mounting base adapted to be assembled to the underside of the carrying handle to provide a scope mounting surface exterior of the carrying handle in a manner which leaves the sight tunnel through the carrying handle unobstructed by the base, wherein the base comprises an elongated body having a generally U-shaped handle-engaging interior contour for mating with the underside of the carrying handle, the handle-engaging interior contour of the base including a recessed central channel aligned with and spaced from the centerline of the underside of the carrying handle when the base is attached to the handle, and further including a rounded, longitudinal handle-contacting rail on each side of the recessed central channel, the handle-contacting rails engaging a radiused underside edge of the carrying handle when the base is attached to the handle to center the base on the handle.

16. The scope mounting base of claim 15, wherein the handle-contacting rails are raised relative to the remainder of the handle-engaging interior contour such that contact between the underside of the carrying handle and the base is limited to the rails.

* * * * *